US011273853B2

(12) United States Patent
Appleby et al.

(10) Patent No.: US 11,273,853 B2
(45) Date of Patent: Mar. 15, 2022

(54) TOP OF RAIL RESILIENT BAR

(71) Applicant: L.B. FOSTER RAIL TECHNOLOGIES, INC., Pittsburgh, PA (US)

(72) Inventors: Glen Appleby, Saint-Lazare (CA); Matthew Redfield, Pittsburgh, PA (US); Charles Schnorr, Pittsburgh, PA (US); Charles A. Petrie, Warren, OH (US)

(73) Assignee: L B Foster Rail Technologies, Inc, Burnaby (CA)

( * ) Notice: Subject to any disclaimer, the term of this patent is extended or adjusted under 35 U.S.C. 154(b) by 0 days.

(21) Appl. No.: 15/918,511

(22) Filed: Mar. 12, 2018

(65) Prior Publication Data

US 2018/0201282 A1 Jul. 19, 2018

Related U.S. Application Data

(60) Division of application No. 14/075,829, filed on Nov. 8, 2013, now Pat. No. 9,914,465, which is a continuation-in-part of application No. 12/788,971, filed on May 27, 2010, now Pat. No. 8,955,645.

(60) Provisional application No. 61/182,217, filed on May 29, 2009.

(51) Int. Cl.
*B61K 3/00* (2006.01)
*E01B 7/26* (2006.01)

(52) U.S. Cl.
CPC . *B61K 3/00* (2013.01); *E01B 7/26* (2013.01)

(58) Field of Classification Search
CPC ..... B61K 3/00; E01B 7/26
See application file for complete search history.

(56) References Cited

U.S. PATENT DOCUMENTS

| | | | |
|---|---|---|---|
| 804,787 | A | 11/1905 | Young |
| 1,097,704 | A | 5/1914 | Cassidy et al. |
| 1,205,711 | A | 11/1916 | Clark |
| 1,546,778 | A | 7/1925 | De Niff |

(Continued)

FOREIGN PATENT DOCUMENTS

| | | | |
|---|---|---|---|
| CA | 2485289 | A1 | 11/2003 |
| CA | 2763205 | A1 | 12/2010 |

(Continued)

OTHER PUBLICATIONS

Chinese Decision on Rejection from Chinese Patent Application No. 201080031049.3, dated Jan. 13, 2015 (with English Translation).

(Continued)

*Primary Examiner* — Michael A Riegelman
(74) *Attorney, Agent, or Firm* — Paul D Bangor, Jr., Esquire; Clark Hill PLC

(57) ABSTRACT

An applicator for applying a friction modifying material to the surface of a rail is provided. The applicator comprises a resilient body for applying a composition to a surface of a rail. The resilient body comprises an outer impervious surface and defines a sealed passageway that extends through the resilient body for the composition to flow through; and an applicator support, wherein the resilient body is secured to the applicator support. A rail applicator assembly and methods for using the applicator are also provided.

20 Claims, 12 Drawing Sheets

(56) References Cited

U.S. PATENT DOCUMENTS

| | | | | |
|---|---|---|---|---|
| 1,630,584 | A | 5/1927 | Schneider | |
| 1,669,603 | A | 5/1928 | Derrick | |
| 1,728,412 | A | 9/1929 | Humphries et al. | |
| 1,745,213 | A | 1/1930 | Gray | |
| 1,803,923 | A | 5/1931 | Tanner | |
| 1,839,427 | A | 1/1932 | Warr | |
| 1,878,259 | A | 9/1932 | Bodkin | |
| 1,939,846 | A | 12/1933 | Fenton | |
| 1,940,527 | A | 12/1933 | Bolt | |
| 1,968,809 | A | 8/1934 | Curtis | |
| 1,978,906 | A | 10/1934 | Madison | |
| 1,979,447 | A | 11/1934 | Butcher et al. | |
| 2,018,402 | A | 10/1935 | Humphries et al. | |
| 2,152,696 | A | 4/1939 | Huck | |
| 2,185,810 | A | 1/1940 | Heidenthal | |
| 2,231,394 | A | 2/1941 | Reece | |
| 2,262,852 | A | 11/1941 | Martin | |
| 2,272,774 | A | 2/1942 | McGarry | |
| 2,489,182 | A * | 11/1949 | Huck | B61K 3/00 184/3.1 |
| 2,555,615 | A | 6/1951 | Stern | |
| 2,821,263 | A | 1/1958 | Kerler | |
| 2,887,179 | A | 5/1959 | Steele et al. | |
| 2,980,942 | A | 4/1961 | Dabney, Jr. | |
| 3,147,822 | A | 9/1964 | Watts | |
| 3,491,338 | A | 1/1970 | Malloy | |
| 3,617,139 | A | 11/1971 | Ross | |
| 4,088,078 | A | 5/1978 | Noble | |
| 4,220,322 | A | 9/1980 | Hobday | |
| 4,436,294 | A | 3/1984 | Irelan | |
| 4,915,195 | A | 4/1990 | Dial | |
| 5,156,508 | A | 10/1992 | Grisley | |
| 5,217,213 | A | 6/1993 | Lii | |
| 5,348,120 | A | 9/1994 | Junk et al. | |
| 5,394,958 | A | 3/1995 | Junk et al. | |
| 5,518,085 | A | 5/1996 | Houser, Jr. et al. | |
| 5,641,037 | A | 6/1997 | Wise et al. | |
| 5,722,509 | A * | 3/1998 | Clinger | B61K 3/00 138/106 |
| 5,957,241 | A | 9/1999 | Anderson | |
| 5,972,470 | A | 10/1999 | Engst | |
| 5,996,736 | A | 12/1999 | Stankiewicz | |
| 6,009,978 | A | 1/2000 | Chisholm | |
| 6,010,268 | A | 1/2000 | Sereg et al. | |
| 6,250,621 | B1 | 6/2001 | Ping | |
| 6,401,867 | B1 | 6/2002 | Michioka et al. | |
| 6,475,594 | B2 | 11/2002 | Johnston et al. | |
| 6,742,624 | B2 | 6/2004 | DiCarlo | |
| 6,759,372 | B2 | 7/2004 | Cotter | |
| 6,899,940 | B2 | 5/2005 | Leriget | |
| 6,971,479 | B1 | 12/2005 | Urmson, Jr. et al. | |
| 7,121,383 | B2 | 10/2006 | Kumar et al. | |
| 7,216,558 | B2 | 5/2007 | Kumar et al. | |
| 7,258,201 | B2 | 8/2007 | Urmson, Jr. et al. | |
| 7,273,131 | B2 | 9/2007 | Urmson, Jr. et al. | |
| 7,530,502 | B2 | 5/2009 | Sherriff et al. | |
| 7,557,147 | B2 | 7/2009 | Martinez et al. | |
| 7,578,388 | B2 | 8/2009 | O'Connell et al. | |
| 8,025,279 | B2 | 9/2011 | Seber | |
| 8,074,772 | B2 | 12/2011 | Urmson, Jr. et al. | |
| 8,235,307 | B2 | 8/2012 | Schatz et al. | |
| 8,584,804 | B2 | 11/2013 | Holland | |
| 8,783,416 | B2 | 7/2014 | Singleton et al. | |
| 2002/0056592 | A1 | 5/2002 | Arens et al. | |
| 2004/0050623 | A1 | 3/2004 | Urmson, Jr. et al. | |
| 2004/0228672 | A1 | 11/2004 | Colburn et al. | |
| 2005/0269161 | A1 | 12/2005 | Urmson et al. | |
| 2008/0047780 | A1 | 2/2008 | Urmson et al. | |
| 2008/0083584 | A1 | 4/2008 | Urmson et al. | |
| 2008/0223661 | A1 | 9/2008 | Singleton et al. | |
| 2009/0000869 | A1 | 1/2009 | Holland | |
| 2009/0000870 | A1 | 1/2009 | Holland | |
| 2009/0050409 | A1 | 2/2009 | Wakamatsu et al. | |
| 2010/0101893 | A1 | 4/2010 | Sutton | |
| 2010/0300810 | A1 | 12/2010 | Singleton et al. | |
| 2014/0054113 | A1 | 2/2014 | Powell et al. | |
| 2014/0060972 | A1 | 3/2014 | Appleby et al. | |

FOREIGN PATENT DOCUMENTS

| | | | |
|---|---|---|---|
| CN | 2037746 | | 5/1989 |
| CN | 2040059 | | 6/1989 |
| EP | 1418222 | A2 | 5/2004 |
| EP | 1807489 | A1 | 7/2007 |
| GB | 2446949 | A | 8/2008 |
| JP | 51-160305 | | 12/1976 |
| JP | 2002-37068 | A1 | 2/2002 |
| JP | 2002-145062 | A | 5/2002 |
| JP | 2003-276604 | A | 10/2003 |
| WO | 87/00566 | A1 | 1/1987 |
| WO | 02/25919 | A1 | 3/2002 |
| WO | 03/064233 | A1 | 8/2003 |
| WO | 03/095283 | A2 | 11/2003 |
| WO | 2006/015494 | A1 | 2/2006 |
| WO | 2008/096109 | A1 | 8/2008 |
| WO | 2010/033900 | A2 | 3/2010 |
| WO | 2010/033907 | A2 | 3/2010 |
| WO | 2010/138819 | A2 | 12/2010 |
| WO | 2014/029028 | A1 | 2/2014 |

OTHER PUBLICATIONS

Chinese Office Action from Chinese Application No. 200980137073.2 dated Apr. 23, 2013 (with English Translation).

Examination Report from Australian Application No. 2009293041 dated Jun. 20, 2013.

Extended European Search Report from European Patent Application No. 09815329.9 dated Dec. 5, 2013.

Extended European Search Report from related European Patent Application No. 10781279.4, dated Feb. 28, 2017.

Final Office Action for U.S. Appl. No. 12/034,871 (dated Apr. 4, 2013).

Final Office Action for U.S. Appl. No. 12/788,971 dated Mar. 14, 2013.

Final Office Action for U.S. Appl. No. 13/935,019, dated Apr. 29, 2014.

Final Office Action for U.S. Appl. No. 13/935,019, dated Oct. 30, 2014.

Final Office Action from U.S. Appl. No. 13/063,553 (dated Mar. 12, 2013).

International Preliminary Report on Patentability for International Patent Application No. PCT/CA2013/050654, dated Dec. 2, 2014.

International Preliminary Report on Patentability for International Patent Application No. PCT/US2009/057671, dated Mar. 22, 2011.

International Search Report and Written Opinion from International Application No. PCT/CA2013/050654, dated Oct. 18, 2013.

International Search Report and Written Opinion from International Application No. PCT/US2009/057671, dated May 4, 2010.

International Search Report and Written Opinion from International Application No. PCT/US2010/036582, dated Dec. 28, 2010.

Non-Final Office Action for U.S. Appl. No. 12/788,971 dated Jun. 19, 2014.

Non-Final Office Action for U.S. Appl. No. 12/788,971 dated Nov. 27, 2012.

Non-Final Office Action for U.S. Appl. No. 13/063,553 (dated Sep. 17, 2012).

Non-Final Office Action for U.S. Appl. No. 13/593,189 dated Dec. 10, 2014.

Non-Final Office Action from U.S. Appl. No. 13/935,019 dated Nov. 14, 2013.

Non-Final Office Action from U.S. Appl. No. 15/452,484, dated Apr. 28, 2017.

Notice of Allowance for U.S. Appl. No. 13/063,553 dated Mar. 6, 2014.

Notice of Allowance from Canadian Patent Application No. 2,622,561, dated Dec. 11, 2014.

Notice of Allowance from U.S. Appl. No. 13/593,189, dated Apr. 1, 2015.

(56) References Cited

OTHER PUBLICATIONS

Notice of Allowance Received in Canadian Patent Application No. 2,881,786, dated Feb. 8, 2017.
Office Action from Canadian Patent Application No. 2,622,561 dated Mar. 26, 2014.
Office Action from Canadian Patent Application No. 2,737,370, dated Sep. 1, 2015.
Office Action from Canadian Patent Application No. 2,763,205, dated Jul. 23, 2015.
Office Action from Canadian Patent Application No. 2,869,485, dated May 19, 2015.
Office Action from Canadian Patent Application No. 2,869,485, dated Sep. 22, 2015.
Office Action from Canadian Patent Application No. 2,869,485, dated Jan. 7, 2015.
Office Action from Chinese Patent Application No. 200980137073.2 dated Nov. 2, 2014.
Office Action from Chinese Patent Application No. 200980137073.2 dated Dec. 20, 2013 (Associate's translation).
Office Action from Chinese Patent Application No. 200980137073.2 dated Dec. 20, 2013.
Office Action from Chinese Patent Application No. 200980137073.2 dated Jan. 29, 2015.
Office Action from Chinese Patent Application No. 200980137073.2 dated Jun. 5, 2014 (Associate's translation).
Office Action from Chinese Patent Application No. 200980137073.2, dated Jun. 1, 2015 (with Associate's Translation).
Office Action from Chinese Patent Application No. 2010800310493, dated Jul. 14, 2014 (English Translation).
Office Action from Chinese Patent Application No. 2010800310493, dated Dec. 2, 2013 (English Translation).
Patent Examination Report No. 1 from Australian Patent Application No. 2010253819, dated Mar. 21, 2014.
Restriction Requirement for U.S. Appl. No. 12/788,971 dated Oct. 12, 2012.
Restriction Requirement from U.S. Appl. No. 14/075,829, dated Sep. 29, 2015.

* cited by examiner

TOP OF RAIL RESILIENT BAR

This application is a Divisional of U.S. application Ser. No. 14/075,829, filed 8 Nov. 2013, which is a Continuation-in-Part of U.S. application Ser. No. 12/788,971 filed 27 May 2010, which claims the benefit of U.S. Provisional Application No. 61/182,217 filed 29 May 2009, which applications are incorporated herein by reference. To the extent appropriate, a claim of priority is made to each of the above disclosed applications.

FIELD OF THE INVENTION

This invention relates to an apparatus for applying compositions to railroad rails.

BACKGROUND OF THE INVENTION

In the operation of railroads, grease or friction modifying compositions are applied onto railroad rails, such as to the top of rails or sides of the rails at curves, turnouts, switches. Compositions that include lubricants and friction modifying materials, such as grease, can either reduce or increase the friction where necessary to improve train performance and reduce wear on both the rails and the train wheels. Some compositions, for example friction modifying materials, that increases the friction between the train wheel and the rail, may be applied to the top of the rail to ensure contact with train wheels during passage of a train consist over the rail. Applicators for applying compositions to the top and side of rails are known, for example U.S. application Ser. No. 12/788,971, UK patent GB2,446,949 (both of which are incorporated herein by reference), U.S. Pat. No. 2,821,263, or U.S. Pat. No. 6,742,624.

Depending upon the composition being applied, and the type of applicator used, friction modifying material may be wasted as the wheel passes along the rail and interacts with the application device. Applicators that apply compositions to the top of the rail may interact with the rail wheel and deform as the wheel passes over the applicator (and track). These applicators need to be durable to withstand repeated contact with train wheels or the harsh conditions to which applicators are exposed, while at the same time deliver a composition to the top of the rail. Applicators comprising a neoprene foam may be incompatible with certain types of friction modifying materials, including water-based and oil-based compositions. In addition, certain applicators used in the prior art may be difficult to manufacture.

SUMMARY OF THE INVENTION

This invention relates to an apparatus for applying compositions to railroad rails.

The present disclosure also provides a rail applicator including a resilient body configured to apply a composition to a surface of a rail. The resilient body comprises an outer impervious surface and defines a sealed passageway that extends through the resilient body for the composition to flow through. The composition is directed to flow through the sealed passageway with none of the composition absorbed by, or penetrating, the resilient body. The applicator may also include an applicator support, with the resilient body being secured to the applicator support. The composition may include a friction modifying material, or a lubricating material.

The present disclosure also provides a rail applicator assembly including a rail having a head portion, a base portion, and a web portion extending between the head portion and the base portion. The head portion defines an outer surface. The rail applicator assembly also includes an applicator for applying a composition to the outer surface of the rail. The applicator includes a resilient body comprising an outer impervious surface and an applicator support. The resilient body is secured to the applicator support and defines a sealed passageway that extends through the resilient body for the composition to flow through. The composition may include a friction modifying material, or a lubricating material.

The resilient body may be constructed of a closed-cell silicone rubber material. Alternatively, the resilient body may be constructed of any other flexible polymeric or hydrocarbon material, provided that the material used provides sufficient resiliency and flexibility to the resilient body to be able to withstand repeated contact with a wheel while in use.

The upper outer surface and sealed passageway of the resilient body are impervious to a composition, for example a friction modifying or lubricating material. The upper outer surface and the sealed passageway of the resilient body if may be coated with a sealant, sealed with an outer closed-cell layer, comprise a silicone or rubber material, or a combination thereof, so that the upper outer surface and sealed passageway of the resilient body are impervious to the composition and do not absorb any friction modifying material. Walls of the resilient body which define the sealed passageway, are made from a silicone or rubber material, coated with sealant, or a combination thereof, to guide the flow of the composition from an inlet port located on a bottom surface of the resilient body, to an exit port located at the top surface of the resilient body, and through the sealed passageway. The bottom and side surfaces of the resilient body may also comprise a silicone or rubber material, be coated with sealant, or a combination thereof. By using a sealed upper surface and sealed passageway, or having all surfaces of the resilient body sealed, the composition does not penetrate the surface of the resilient body, nor does the resilient body absorb any of the composition. The composition may include a friction modifying material, or a lubricating material.

The sealed passageway may extend from an inlet port located at a bottom surface to an exit port located on a top surface of the resilient body. The sealed passageway may be angled from the inlet port on the bottom surface towards the exit port at the top surface of the resilient body with the exit port positioned along an edge of the top surface. The sealed passageway may be wider in cross section at a top portion of the resilient body than a lower portion of the resilient body. For example, the sealed passageway may be wider at the exit port than at the inlet port, the inlet port, exit port and sealed passageway may be of a same width, or the sealed passageway may be narrower at exit port than at the inlet port. The exit port of the sealed passageway may be substantially slot-shaped, or substantially circular-shaped.

The applicator support may include a generally U-shaped elongate body. One surface of the elongate body defining an opening that aligns with the inlet port of the resilient body when the resilient body is attached. The applicator support may include a pair of extensions that extend from the generally elongate body to permit installation of the applicator support to the rail.

When installed against a rail, the resilient body is positioned so that a side of resilient body (front surface) engages the head portion of the rail, with the top surface of the resilient body in line with, or inclined toward the head portion of the rail.

More than one applicator may be installed against the rail in series, each applicator in fluid communication with a reservoir and pump. Furthermore, each of the one or more applicators may comprise one or more than one exit ports. With this configuration, reduced volumes of composition may be delivered from each exit port to the rail surface, resulting in reduce spillage of the composition from the applicator. Furthermore, by having multiple sites for the delivery of the composition to the rail surface, the transfer of the composition from the rail surface to the wheel may be more efficient with a larger surface area of the wheels receiving the composition, than when using one applicator with one exit port.

Also provided is a method of applying a composition to a rail comprising the step of engaging a head portion of a rail with an applicator. The composition may include a friction modifying material, or a lubricating material. The applicator includes a resilient body comprising an outer impervious surface and an applicator support. The resilient body is secured to the applicator support and defines a sealed passageway that extends from an inlet port on the bottom surface through the resilient body to an exit port on the top surface. The method also comprises the step of applying the composition to the head portion of the rail by passing the composition through the sealed passageway and exiting the sealed passageway via an exit port. The composition flows through the sealed passageway only, with none of the composition absorbed by, or penetrating, the matrix of the resilient body. The method may also comprise the step of compressing the applicator such that the exit port is substantially closed prior to the composition exiting through the exit port.

This summary of the invention does not necessarily describe all features of the invention. Other aspects, features and advantages of the present disclosure will become apparent to those of ordinary skill in the art upon review of the following description of specific embodiments of the invention.

BRIEF DESCRIPTION OF THE DRAWINGS

These and other features of the invention will become apparent from the following description in which reference is made to the appended drawings, wherein.

DETAILED DESCRIPTION OF THE INVENTION

Figure 1:
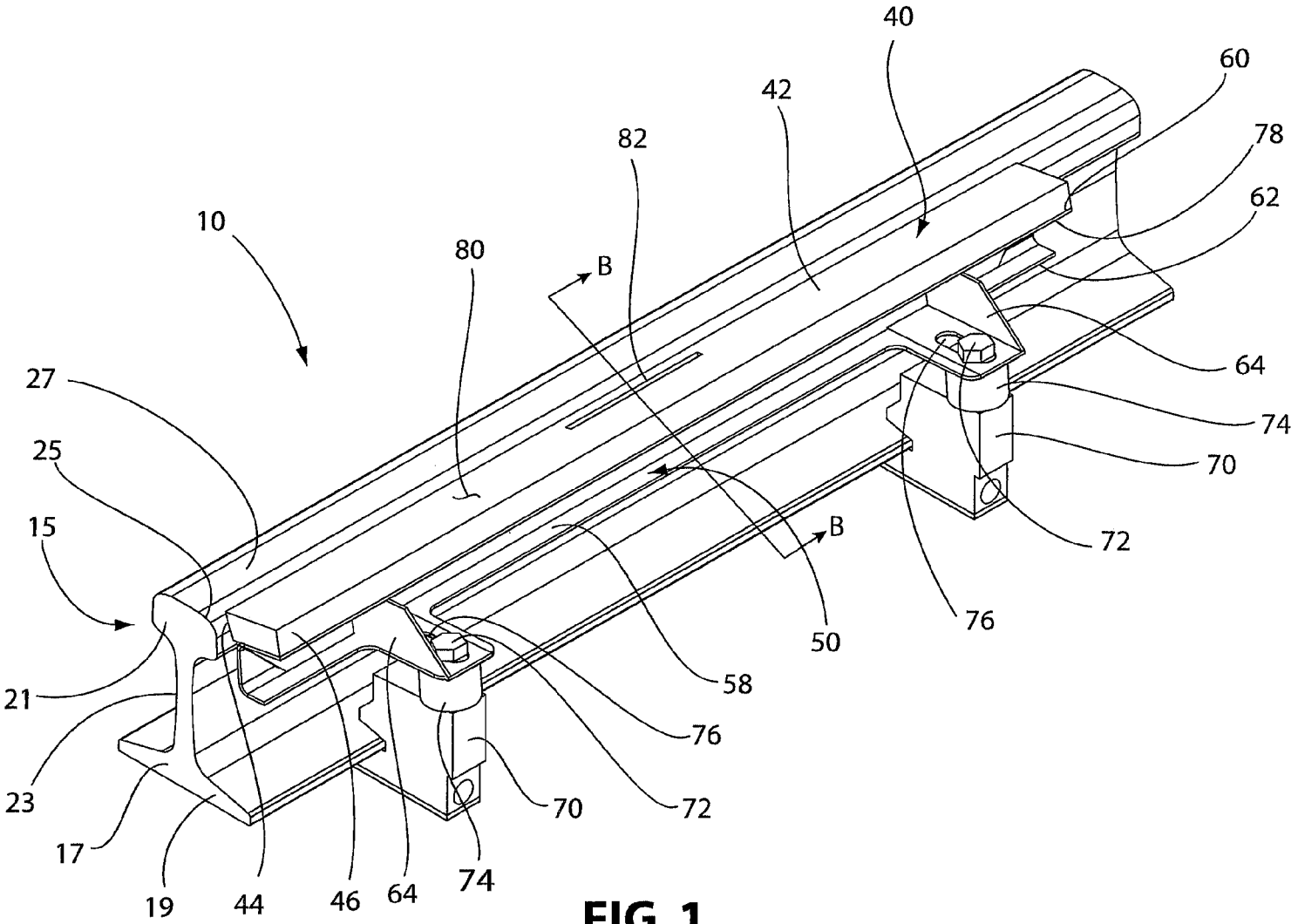
FIG. 1 is a perspective view of a rail applicator according to one embodiment of the present invention.
Figure 2:
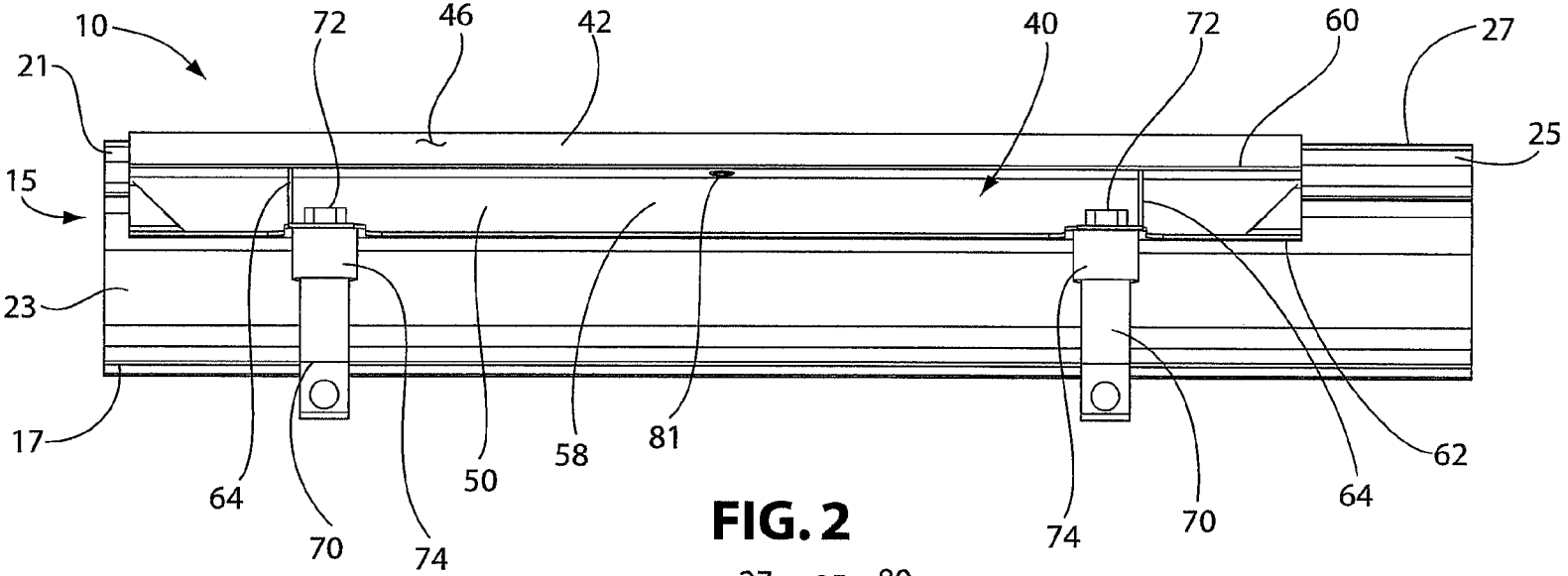
FIG. 2 is a rear view of the rail applicator shown in FIG. 1.
Figure 3:
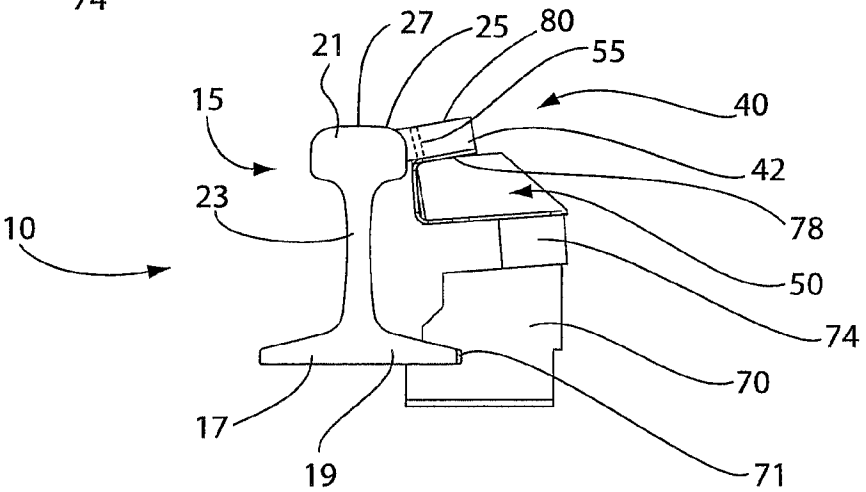
FIG. 3 is a side view of the rail applicator shown in FIG. 1.
Figure 4:
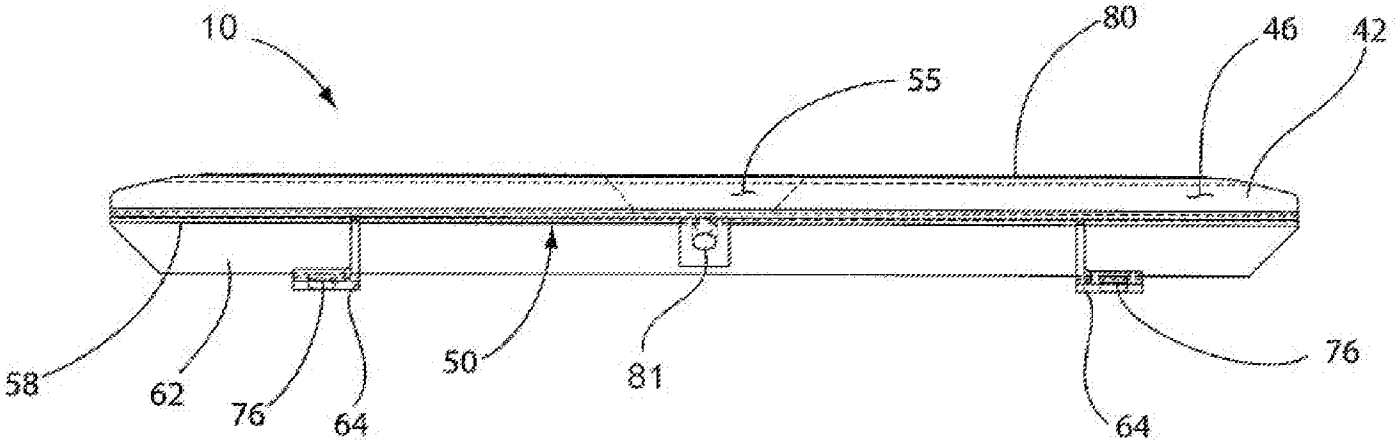
FIG. 4 is a rear view of the rail applicator shown in FIG. 1.

This invention relates to an apparatus for applying compositions to railroad rails.

For the purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

Referring to Figures, a rail applicator assembly 10 is shown. The rail applicator assembly 10 includes a railroad rail 15 and an applicator 40 for applying a composition, for example a friction modifying material or a lubricant material, to the rail 15. The rail 15 includes a base portion 17 with flanges 19 extending therefrom and a head portion 21 having a web portion 23, which extends between the head portion 21 and the base portion 17. The head portion 21 of the rail 15 has an outer surface 25 defining a crown 27. The applicator 40 is configured to apply a composition, for example a friction modifying or lubricating material, to the outer surface 25, 27 of the head portion 21 of the rail 15.

Any liquid composition that can be pumped from a reservoir to the resilient body may be applied using the applicator 40 of the present invention as would be readily determined by one of skill in the art. Non-limiting examples of compositions that may be applied include but are not limited to those described in U.S. Pat. Nos. 6,135,767; 6,387,854; 5,492,642; US 2004/0038831 A1; WO 2002/26919 (US 2003 0 195 123 A1); WO 98/13445; CA 2,321,507; EP 1,357,175; EP 1,418,222; U.S. Pat. Nos. 6,795,372; 7,244,695; 7,357,427; 6,855,673 (which are incorporated herein by reference).

Figure 8:
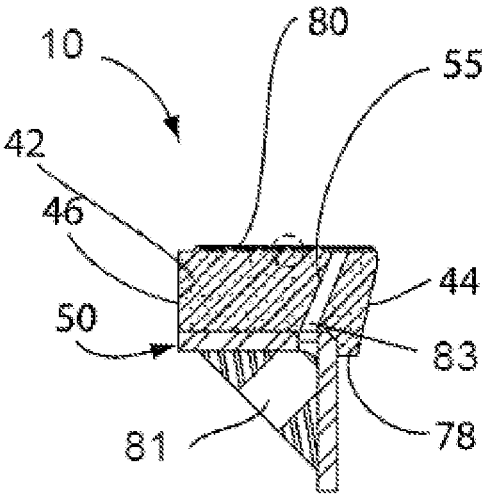
FIG. 8 is a cross-sectional view of the rail applicator shown in FIG. 1, taken along the line A-A of FIG. 7.
Figure 9:
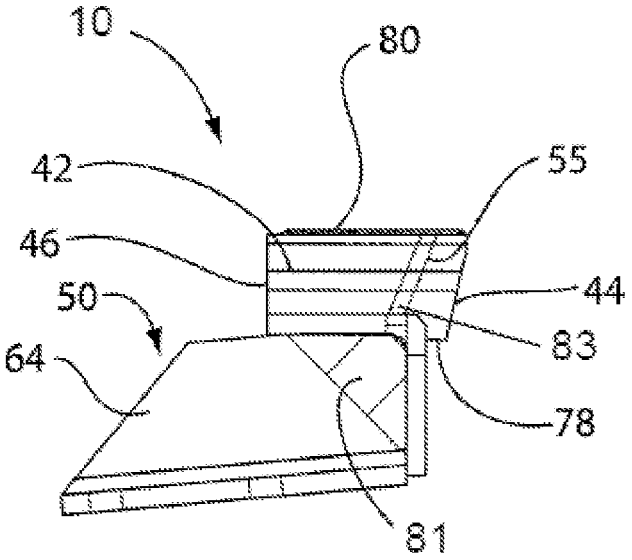
FIG. 9 is an enlarged side view of the rail applicator shown in FIG. 1.]

The applicator 40 includes a resilient body 42 having a front surface 44 and a rear surface 46, a top surface 80, a bottom surface 78, an inlet port 83, an exit port 82 and a sealed passageway 55 connecting the inlet 83 (see FIGS. 8, 9) and exit 82 ports of the resilient body. The bottom surface 78 of the resilient body 42 is attached to an upper surface 60 of an applicator support 50. The applicator support 50 positions and supports the applicator 40 adjacent to the head portion 21 of the rail 15.

The resilient body 42 is an elongate member generally having a rectangular shape, although other suitable shapes may be utilized for the resilient body 42. The resilient body 42 is be constructed using a polymeric or hydrocarbon material that provides sufficient resiliency and flexibility to the resilient body 42. For example the material may be a silicone, a rubber, a flexible closed-cell, or other suitable material that is chemically inert or chemically compatible with the composition, for example, a friction modifying, or lubricating, material, that is applied to rail 15.

The upper outer (top) surface 80 and sealed passageway 55 of the resilient body 42 are impervious to the composition, for example a friction modifying or lubricating material. The upper outer surface and the sealed passageway of the resilient body if may be coated with a sealant, sealed with an outer closed-cell layer, comprise a silicone or rubber material, or a combination thereof, so that the upper outer surface and sealed passageway of the resilient body are impervious to the composition and do not absorb the composition. Walls of the resilient body 42 which define the sealed passageway 55, may be made from a silicone or rubber material, coated with sealant, or a combination thereof, to guide the flow of the composition from an inlet port 83 located on a bottom surface 78 of the resilient body, to an exit port located at the top surface of the resilient body, and through the sealed passageway. The bottom and side surfaces of the resilient body may also comprise a silicone or rubber material, be coated with sealant, or a combination thereof. By using a sealed upper surface and sealed passageway, or having all surfaces of the resilient body sealed, the friction modifying material does not penetrate the matrix of the resilient body, nor does the resilient body absorb any of the composition.

The material of the resilient body 42 may also be an open-cell material, such as a neoprene foam of suitable resiliency to withstand repeated passes of a train wheel, provided that the surfaces of the open-cell material of the resilient body that are in contact with the composition are sealed surfaces. A sealed surface may include coating the surface of open-celled material with a sealant that is resistant to the composition, for example silicone sealant, the surface may be heat-sealed during or after manufacture, or the surface may have a layer of a closed-cell material, such as rubber or silicone secured to the surface. In this way, the sealed surface of the open-celled material is a closed-celled surface.

By having sealed surfaces of the resilient body, or if the resilient body is made from a polymeric or hydrocarbon material for example silicone or rubber, then the composition does not penetrate the surface of the resilient body, nor does the resilient body absorb any of the composition.

The resilient body may also be made from a combination of open-cell and closed-cell materials, provided that the material, or combination of materials, is chemically inert, chemically compatible, or both, with the composition, and the material, or materials, is sufficiently resilient and flexible to allow the resilient body 42 to deflect out of the way when contacted by a rail wheel and to subsequently return to its original position during use. Furthermore, the surfaces, of the resilient body made from a combination of open-cell and closed-cell materials, that contact the composition are impervious to the composition so that, the composition does not penetrate within the resilient body, nor does the resilient body absorb any of the composition. Examples of a suitable material for a resilient body includes a hollow silicone rubber member having sufficient resiliency and flexibility to deflect out of the way when contacted by a rail wheel and to subsequently return to its original position during use. Alternatively, the resilient body may be a solid resilient body made from silicone rubber having sufficient resiliency and flexibility to deflect out of the way when contacted by a rail wheel and to subsequently return to its original position during use. The resilient body further comprises a passageway from the inlet port 83 to the exit port 82 of the resilient body.

Regardless of whether it is hollow or solid or what material is used for constructing the resilient body 42, the entire outer surface of the resilient body 42 is designed to be impervious to the composition, including liquid or paste-like materials, a friction modifying material, a lubricating material, a water-based material, an oil-based material, a grease, an oil, or a mixture thereof. Moreover, the impervious outer surface provides resistance to the buildup of composition materials on the outer surfaces of the resilient body, facilitating ongoing maintenance of the applicator 40. Even if the composition does coat the outer surface of the resilient body 42, the outer impervious surface of the resilient body 42 allows the composition to be easily removed, for example, wiped or peeled away, from the resilient body 42.

Where the resilient body 42 is constructed of a closed-cell material, such as silicone rubber, an impervious sealant or outer closed-cell layer is not necessary so long as the entire outer surface of the resilient body 42 is impervious to the friction modifying material. Closed-cell materials, therefore, simplify the manufacture of the resilient body 42, which may be desired in certain situations.

The resilient body 42 further defines a sealed passageway 55 that extends through the resilient body 42 for the friction modifying material to flow through. The sealed passageway 55 may be directly formed in the resilient body 42. Alternatively, the sealed passageway 55 may be defined by a separate insert (not shown) positioned within the resilient body 42 connecting the inlet 83 and exit 82 ports of the resilient body.

If the resilient body 42 is constructed of an open-cell material, or a combination of an open-cell and closed-cell material, in order to maintain the impervious nature of the resilient body 42, the surface of the walls within the resilient body 42 the define the sealed passageway 55, or define the space through which the separate insert passes, is coated with a sealant or comprises a closed-cell layer, as described above. In this way, the composition is restricted to flow through the sealed passageway 55 and the resilient body does not absorb the composition, nor does the composition penetrate or enter the matrix of the resilient body. If the resilient body 42 is constructed of a closed-cell material, such as silicone rubber, it is not necessary to coat the walls of the resilient body 42 which define the sealed passageway 55 with a sealant or to add a closed-cell layer, thereby simplifying the manufacture of the resilient body 42.

The resilient body 42 may be made using an extrusion process. In particular, the resilient body 42 may be made from a silicone or rubber composition (or a composition of any other resilient material, as described above) by introducing the silicone or rubber composition (or any other composition) into a continuous extrusion mold to form an uncured silicone rubber molding, and subjecting the uncured silicone rubber molding to cure at ambient pressure in a hot gas of 200 to 600° C., or any temperature therebetween, to produce the silicone rubber resilient body 42. The sealed passageway 55 may be formed in the resilient body 42 using conventional means known in the art, for example, using a water jet, razor knife fixture, or laser beam to cut the sealed passageway 55. This manufacturing process is fairly straightforward and simplifies the manufacture of the applicator 40, especially when a closed-cell material is used for the resilient body 42 and no additional sealant or closed-cell layer is required on the outer surface of the resilient body 42.

Alternatively, the resilient body 42 may be made using a mold and a silicone or rubber composition (or any other composition as described above). With this manufacturing process, the sealed passageway 55 formed through the resilient body 42 can be directly molded in, thus further simplifying the manufacture process. Using a molding process for manufacturing the resilient body 42 may also facilitate the generation of additional shapes and configurations for the resilient body 42, which may be required depending on the composition material to be applied, or the location of the rail that the applicator is mounted.

The applicator 40 and resilient body 42 may be of any suitable length, for example from about 6 inches (15 cm) to about 50 inches (1.3 m), or any length therebetween. For example the applicator may be of a length from about 6, 8, 10, 12, 14, 126, 18, 20, 22, 24, 26, 28, 30, 32, 34, 36, 38, 40, 42, 44, 46, 48, 50 inches, or any length there between.

The applicator support 50 includes a generally C-shaped elongate body 58 having an upper surface 60 and a lower surface 62. Further, a pair of extensions 64 extends from the elongate body 58 away from the rail 15. As shown in FIGS. 1-4 4, the resilient body 42 is secured to the upper surface 60 of the applicator support 50. In particular, the resilient body 42 may be directly formed on or bonded to the upper surface 60 of the applicator support 50. Any type of bonding material or glue may be used to bond the resilient body 42 to the applicator support 50, for example, a silicone adhesive may be used. Directly forming the resilient body 42 on the applicator support 50 or directly bonding the resilient body 42 to the applicator support 50 further seals a bottom surface 78 of the resilient body 42 and reduces penetration by the composition into the resilient body. This configuration (i.e. a sealed passageway, and a sealed bottom surface) may also result in less wastage or spillage of the composition at the inlet port 81, since the composition is efficiently delivered though the inlet port—sealed passageway junction.

The applicator 40 and applicator support 50 are mounted to the rail 15 through two mounting clamps 70. Each of the mounting clamps 70 has a recess 71 configured to receive the flange 19 of the rail 15. Each mounting clamp 70 also includes a bolt (not shown) having a J-shaped end configured to receive the flange 19 and a threaded end that passes through the mounting clamp 70. The mounting clamp 70 may be the same mounting clamp arrangement disclosed in U.S. Pat. No. 7,273,131 (which is hereby incorporated herein by reference).

Figure 5:
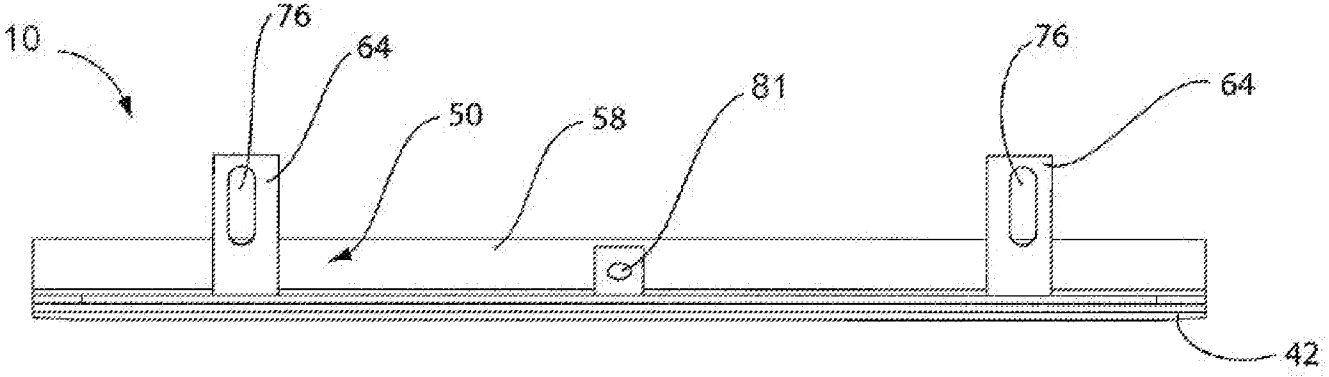
FIG. 5 is a bottom view of the rail applicator shown in FIG. 1.
Figure 6:
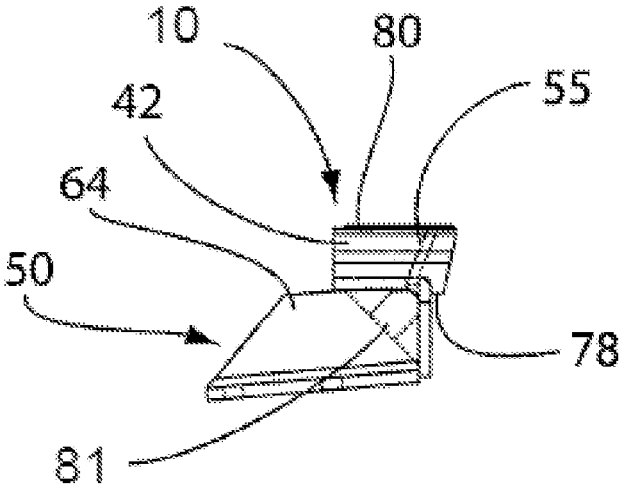
FIG. 6 is a side view of the rail applicator shown in FIG. 1.

The extensions 64 of the applicator support 50 are secured to respective mounting clamps 70 via fasteners 72 with spacers 74 being provided between an upper surface of the mounting clamps 70 and the extensions 64. In particular, the fasteners 72, such as bolts, are inserted through respective openings 76 in the extensions 64 and are threadably secured to the mounting clamps 70 thereby securing the applicator support 50 to the mounting clamps 70. As shown in FIG. 5, the openings 76 in the extensions 64 are generally slot-shaped to allow adjustment of the applicator 40 and support 50 relative to the rail 15, although other suitably shaped openings in each extension 64 may be utilized.

Applicator 40 is arranged to provide the composition adjacent the field surface or outside surface of the rail head 21 as opposed to the gauge surface or inside surface of the rail head 21. The applicator 40 is inclined downwardly toward the head portion 21 of the rail 15 to reduce the flow of friction modifying material in a direction opposite from the rail head 21 (see FIG. 3). In particular, the front surface 44 of the resilient body 42, which engages the head 21, has a lower position than the rear surface 46 of the resilient body 42 relative to the rail head 21. Thus, the friction modifying material is provided through the sealed passageway 55 of the resilient body 42 and is maintained at a position adjacent to the outer surface 25 of the rail head 21 by the resilient body 42. As the entire outer surface of the resilient body 42 is designed to be impervious to the friction modifying material, including the front surface 44, the rear surface 36 and the top surface 80, the friction modifying material does not absorb into the resilient body and remains at the position adjacent to the outer surface 25 of the head portion 21 until it is applied to the head portion 21 of the rail 15, as described below. The resilient body 42 deflects out of the way when contacted by a rail wheel and subsequently returns to its original position due to the resiliency and flexibility of the resilient body 42.

As shown in FIGS. 1-6, 8 and 9 the sealed passageway 55 extends from the bottom surface 78 of the resilient body 42 to a top surface 80 of the resilient body 42. An inlet port 81 defined by the applicator support 50, is in fluid communication with the inlet port 83 of the resilient body 42. As shown more clearly in FIGS. 6, 8 and 9, the inlet port 81 is in fluid communication with the inlet port 83 and sealed passageway 55 of the resilient body. The inlet port 81 is generally positioned at a central portion of the applicator support 50 and resilient body 42, although other suitable positions for the inlet port 81 may be used. The composition may be supplied to the inlet port 83 via piping or tubing (not shown) that leads to a reservoir (not shown) containing the composition material. A pump actuator (not shown) is secured to the rail and includes a pump that is in fluid communication with the reservoir.

In use the applicator 40 is in fluid communication with a storage tank containing the composition, and a pump to deliver the composition to the inlet port 83 of the applicator, through the sealed passageway 55, out the exit port 82 to the top surface 80 of the resilient body 42. For example, the applicator assembly 10, mounted on a rail may be in fluid communication with a wayside management system as described in WO 2011/143765 (which is incorporated herein by reference). The wayside management system may comprise one or more than one applicator mounted on the track, a power source operatively connected to a pump, the pump is in fluid communication with a reservoir comprising the composition, the applicator is in fluid communication with the reservoir and applies the composition transferred from the reservoir to the surface of the track. The wayside management system may further include one or more than one data collection module located at or adjacent to the one or more than one applicator, the one or more data collection module for collecting and transmitting data for example, by radio frequency, cellular communications channels, or both, to a remote performance monitoring unit, the data comprising performance information, track status information, information of an environment of the track, information of a train, or a combination thereof. The remote performance monitoring unit may comprises a database for storing the transmitted data as described in WO2011/143765.

In order to minimize the spillage of the composition from the top surface 80 resilient body when a rail wheel passes over the resilient body 42, multiple applicators 40 in fluid communication with a reservoir and pump, may be placed in series against a rail 15, so that each applicator receives a reduced amount of composition when compared to the amount of composition delivered to one applicator, if only one applicator was to receive the composition. For example, from about one to 10 applicators, or any number therebetween, may be placed in series adjacent a rail. For example, 1, 2, 3, 4, 5, 6, 7, 8, 9, 10 applicators, or any number therebetween, may be in fluid communication with a reservoir and pump, or a wayside management systems as described in WO2011/143765 (which is incorporated herein by reference). If more than one applicator is mounted against a rail, the length of each of the mounted applicators may be reduced, for example from about 6 inches (15 cm) to about 36 inches (1 m), or any length therebetween. For example the applicator may be of a length from about 6, 8, 10, 12, 14, 126, 18, 20, 22, 24, 26, 28, 30, 32, 34, 36 inches, or any length there between. When mounted against a rail, the applicators may be spaced apart with a gap or space between each applicator of about 6 inches (15 cm) to about 36 inches (1 m), or any length therebetween. For example the space between each applicator may be from about 6, 8, 10, 12, 14, 126, 18, 20, 22, 24, 26, 28, 30, 32, 34, 36 inches, or any length there between.

Spillage of the composition from the top surface 80 resilient body when a rail wheel passes over the resilient body 42, may also be reduced by using an applicator comprising multiple exit ports 82, for example two or more exit ports, with each or the multiple exit ports is in fluid communication with a reservoir and pump. In this configuration, each exit port 82 receives a reduced amount of composition when compared to the amount of composition delivered to one exit port if only one exit port was positioned on an applicator. For example, from about one to about 10 exit ports, or any number therebetween, may be placed along an applicator. For example, 1, 2, 3, 4, 5, 6, 7, 8, 9, 10 exit ports, or any number therebetween, may be in fluid communication with a reservoir and pump, or a wayside management systems as described in WO2011/143765 (which is incorporated herein by reference). Each of the two or more exit ports may be in fluid communication with a separate sealed passageway 55, and a separate inlet port 83, with the inlet ports in fluid communication with the reservoir via a manifold or fluid distribution system, or one or more sealed passageway may be in fluid communication with a corresponding number of inlet ports, with the one or more sealed passageway branching so that each of the one or more exit ports is in fluid communication with one arm of a branched sealed passageway. The two or more exit ports may be spaced apart with a gap or space between each exit port of about 1 inch (2.5 cm) to about 12 inches (30 cm), or any length therebetween. For example the space between each exit port may be from about 1, 2, 3, 4, 5, 6, 7, 8, 9, 10, 11, 12 inches, or any length there between. By using two or more exit ports along an applicator 40, lower volumes of composition may be delivered to each exit port, while still achieving an efficient transfer from the applicator to the rail surface (and to a wheel surface), when compared to using one applicator with one exit port. Furthermore, by reducing the volume of composition delivered at each exit port, there is reduced spillage of the composition when a wheel passes across the applicator and deforms the resilient body.

Alternatively, a combination of multiple applicators positioned in series against a rail as described above, and each applicator comprising one or more exit ports, as described above, may be used to deliver the composition to the rail surface. With this configuration, reduced volumes of composition may be delivered at each exit port to the rail surface and reduce spillage of the composition from the applicator. Furthermore, by having multiple sites for the delivery of the composition to the rail surface, the transfer of the composition from the rail surface to the wheel may be more efficient (i.e. larger surface area of the wheels receiving the composition) than when using one applicator with one exit port.

Figure 7:
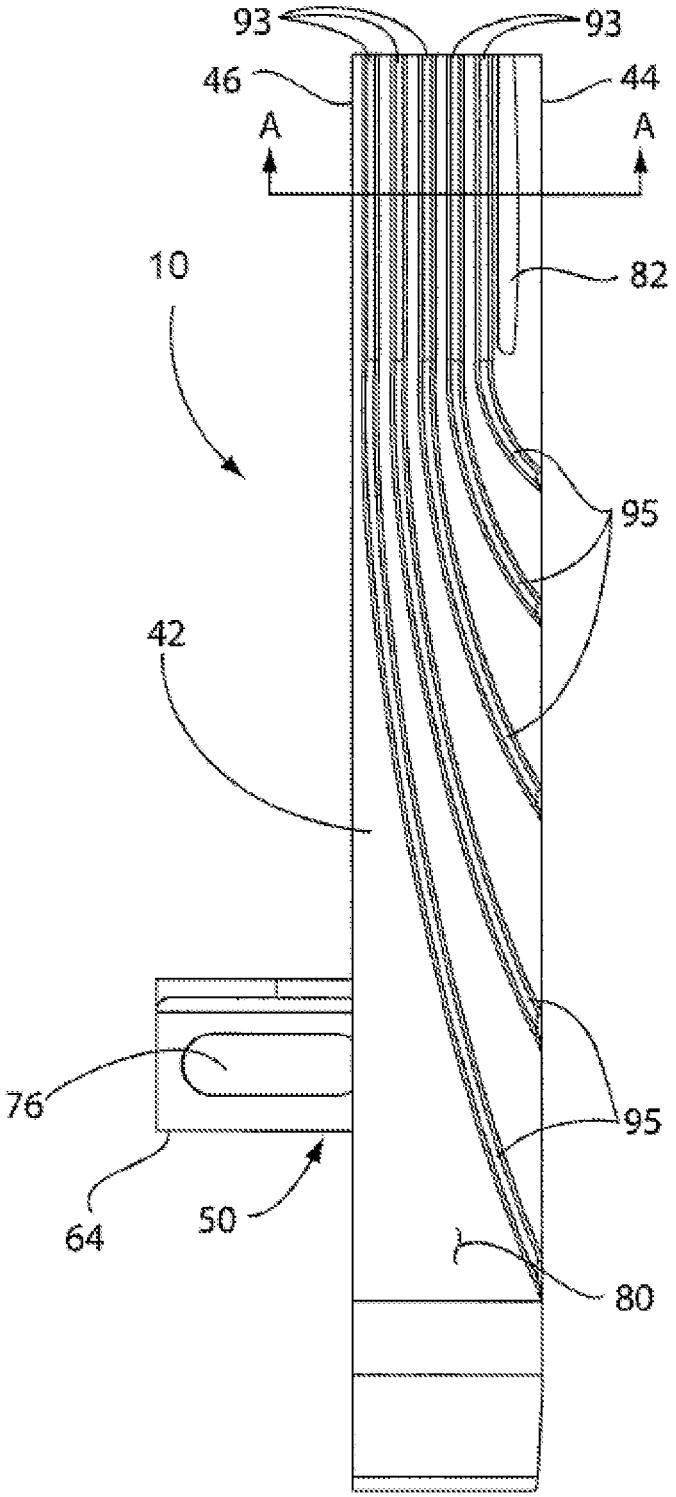
FIG. 7 is an enlarged partial top view of the rail applicator shown in FIG. 1.
Figures 10, 11:
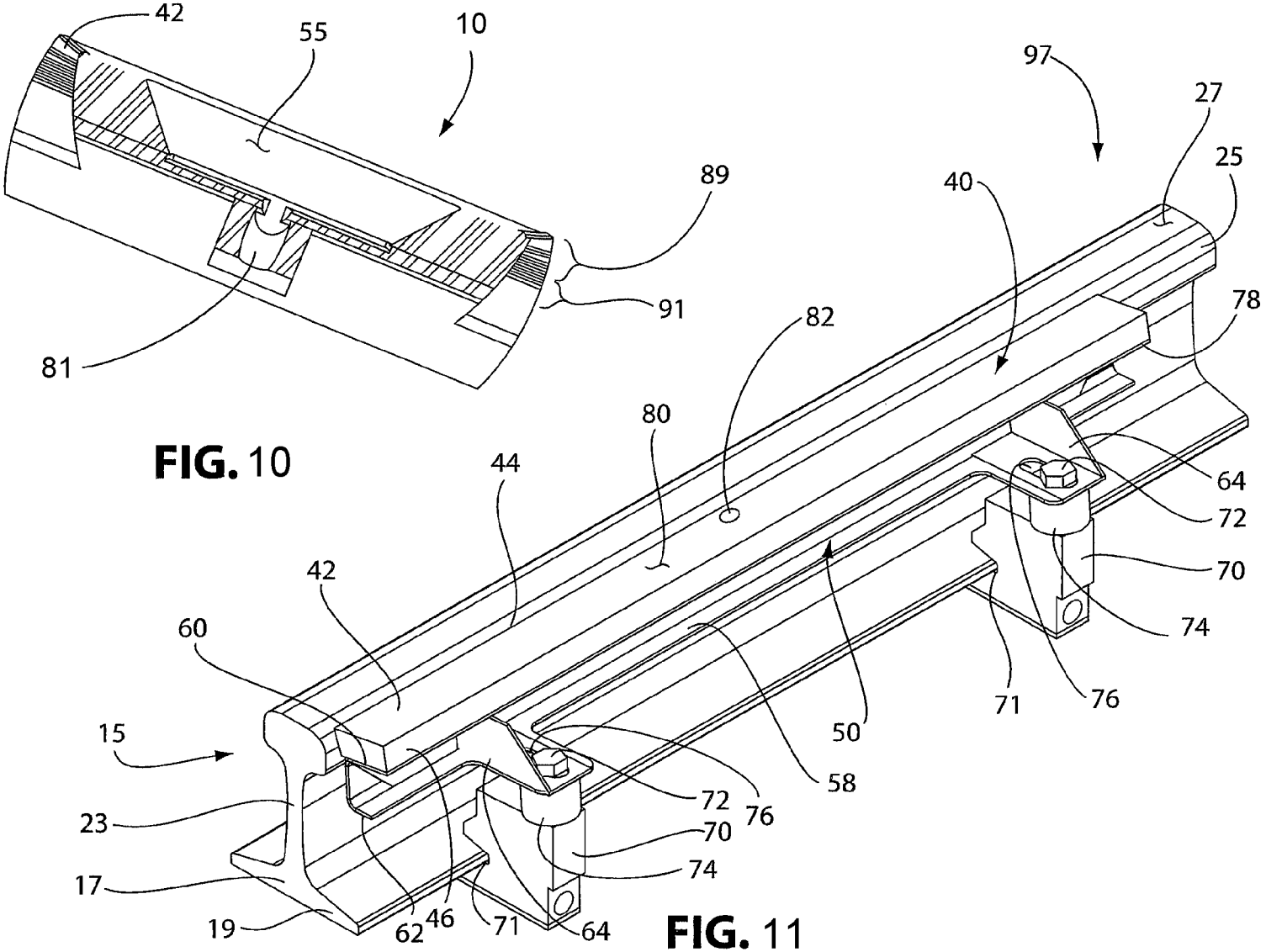
FIG. 10 is a partial sectional view of an intermediate portion of a rail applicator according to another embodiment of the present invention.
FIG. 11 is a perspective view of a rail applicator according to another embodiment of the present invention.
Figure 12:
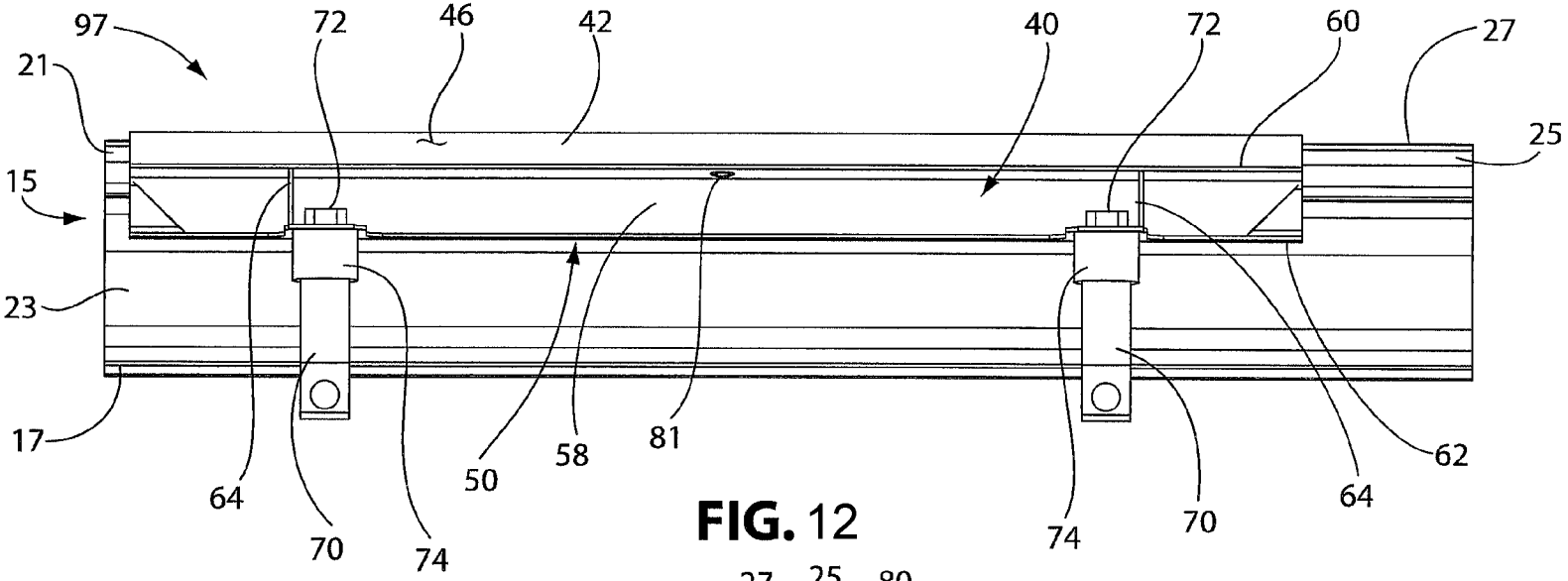
FIG. 12 is a rear view of the rail applicator shown in FIG. 11.
Figure 13:
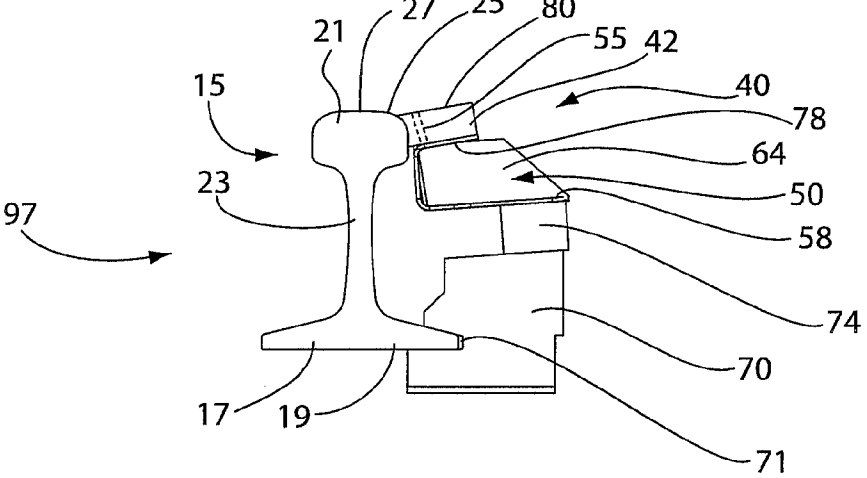
FIG. 13 is a side view of the rail applicator shown in FIG. 11.

The top surface 80 of the resilient body 42 defines an exit port 82 of the sealed passageway 55. The exit port 82 of the sealed passageway 55 may be of any shape including slot-shaped, for example, as shown in FIG. 7, or wider at a top portion 89 of the resilient body 42 than a lower portion 91 of the resilient body 42 as in FIG. 10. In this example the sealed passageway 55 may taper outward as it extends from the inlet port 83 at the bottom surface 78 to the outlet port 82 at the top surface 80 of the resilient body 42. This configuration may assist in directing the friction modifying material towards the top surface 80 of the resilient body 42 for application to the head portion 21 of the rail 15. Alternatively, the exit port 82 may be circular-shaped as shown in FIGS. 11-13.

When the resilient body 42 is engaging the head portion 21 of the rail 15, the exit port 82 closes at the top surface 80 of the resilient body 42 due to the compression of the resilient body 42 in the mounting position. This configuration seals air from the exit port 82 at the top surface 80, yet opens when pressure is exerted on the composition causing the composition to exit the exit port 82 and reach the top surface 80. The sealed passageway 55 may also be angled towards the front surface 44 of the resilient body 42 as it extends from the bottom surface 78 to the top surface 80. The sealed passageway 55 may also extend in a direction that is perpendicular with the top surface 80 of the resilient body 42 or any other suitable direction through the resilient body 42. Although a single sealed passageway 55, inlet port 81 and exit port 82 are disclosed, the applicator 40 may include a number of sealed passageways 55, inlet ports 81, and exit ports 82.

To help distribute the composition along the top surface 80 of the resilient body, ribs (or grooves), 93, 95, may be included on the top surface 80 of the resilient body 42.

Figure 14A:
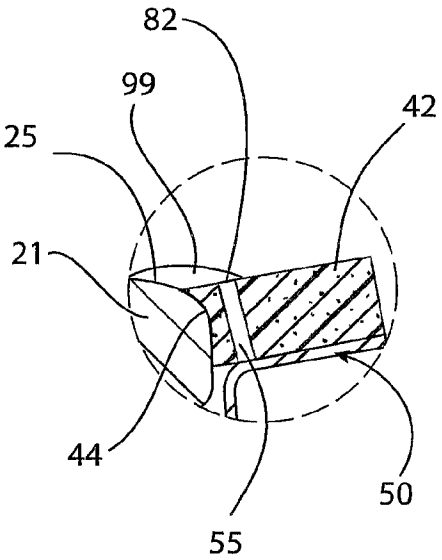
FIG. 14A is a detailed view of the area shown in FIG. 14.
Figure 14:
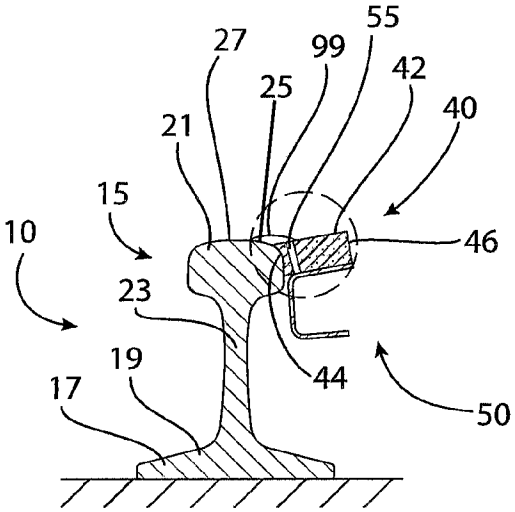
FIG. 14 is a cross-sectional view of the rail applicator shown in FIG. 1, taken along the line B-B of FIG. 1 and showing friction modifying material exiting the applicator.
Figure 15:
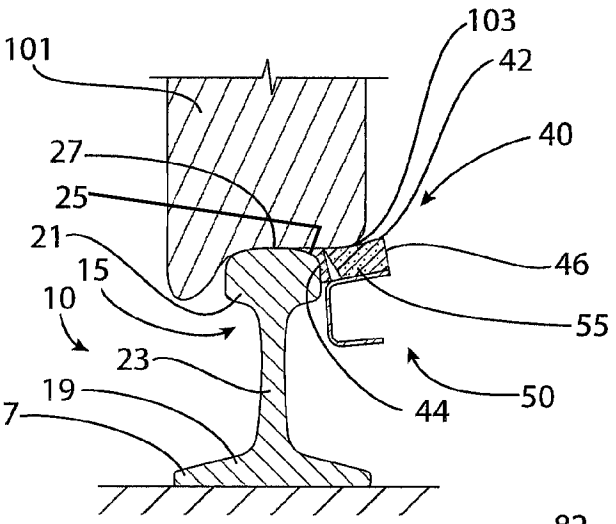
FIG. 15 is a cross-sectional view of the rail applicator shown in FIG. 1, taken along the line B-B of FIG. 1 and showing a rail wheel contacting the applicator.
Figure 16A:
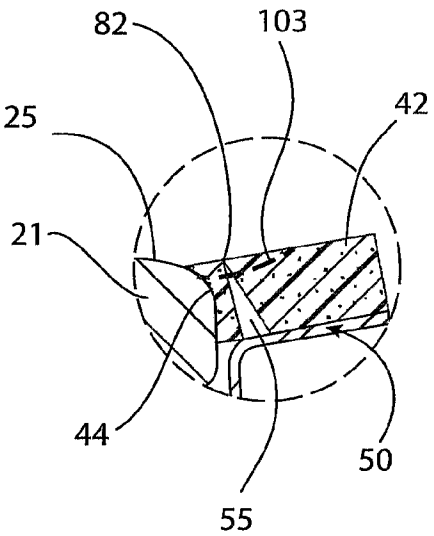
FIG. 16A is a detailed view of the area shown in FIG. 16.
Figure 16:
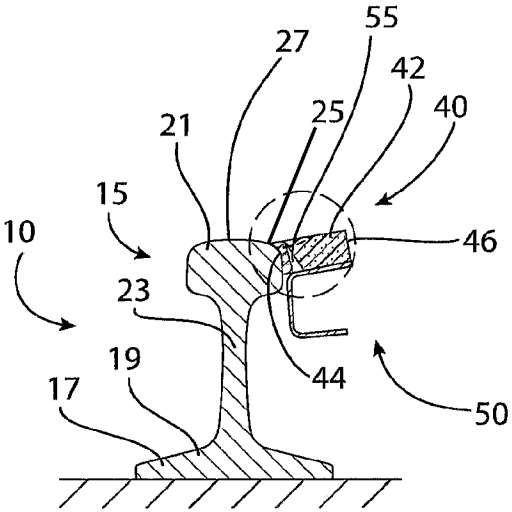
FIG. 16 is a cross-sectional view of the rail applicator shown in FIG. 1, taken along the line B-B shown in FIG. 1 and showing the applicator returning to its original form.

Referring to FIGS. 14-16A, the operation of the applicator 40 is disclosed. In particular, as shown in FIGS. 14 and 14A, the applicator 40 is positioned adjacent to the head portion 21 of the rail 15 in order to apply friction modifying material to the rail 15, which is retained in position adjacent to the head portion 21 and does not absorb into or penetrate the top surface 80 of the resilient body 42. The resilient body 42 of the applicator 40 engages the head portion 21 of the rail, which compresses the resilient body 42. Friction modifying material 99 is applied to the head portion 21 of the rail 15 by distributing the friction modifying material 99 through the sealed passageway 55 and exiting the sealed passageway 55 via the exit port 82. The resilient body 42 maintains the friction modifying material 99 on its outer impervious surface and directs the friction modifying material 99 toward the crown 27 of the rail 15. As shown in FIG. 15, when rail wheel 101 passes the applicator 40, the wheel 101 engages and compresses the resilient body 42 to define a depressed portion 103. The resilient body 42 of the applicator 40 is configured to conform to the profile of the rail wheel 101 such that the applicator 40 accommodates new rail wheels or worn rail wheels having varying dimensions. As shown in FIGS. 16 and 16A, after the rail wheel 101 passes by the applicator 40, the depressed portion 103 of the resilient body 42 caused by the passing wheel 101 expands and the resilient body 42 returns to its original form. Further, as shown in FIGS. 14A and 16A, the resilient body 42 of the applicator 40 is compressed against the rail 15 such that the exit port 82 is substantially closed when friction modifying material 99 is not exiting through the exit port 82. This allows the exit port 82 to be closed when friction modifying material 99 is not flowing through the sealed passageway 55 (shown in FIG. 16A), but still allows free flow through the passageway 55 upon distribution of the friction modifying material 99 (shown in FIG. 14A).

Figure 17:
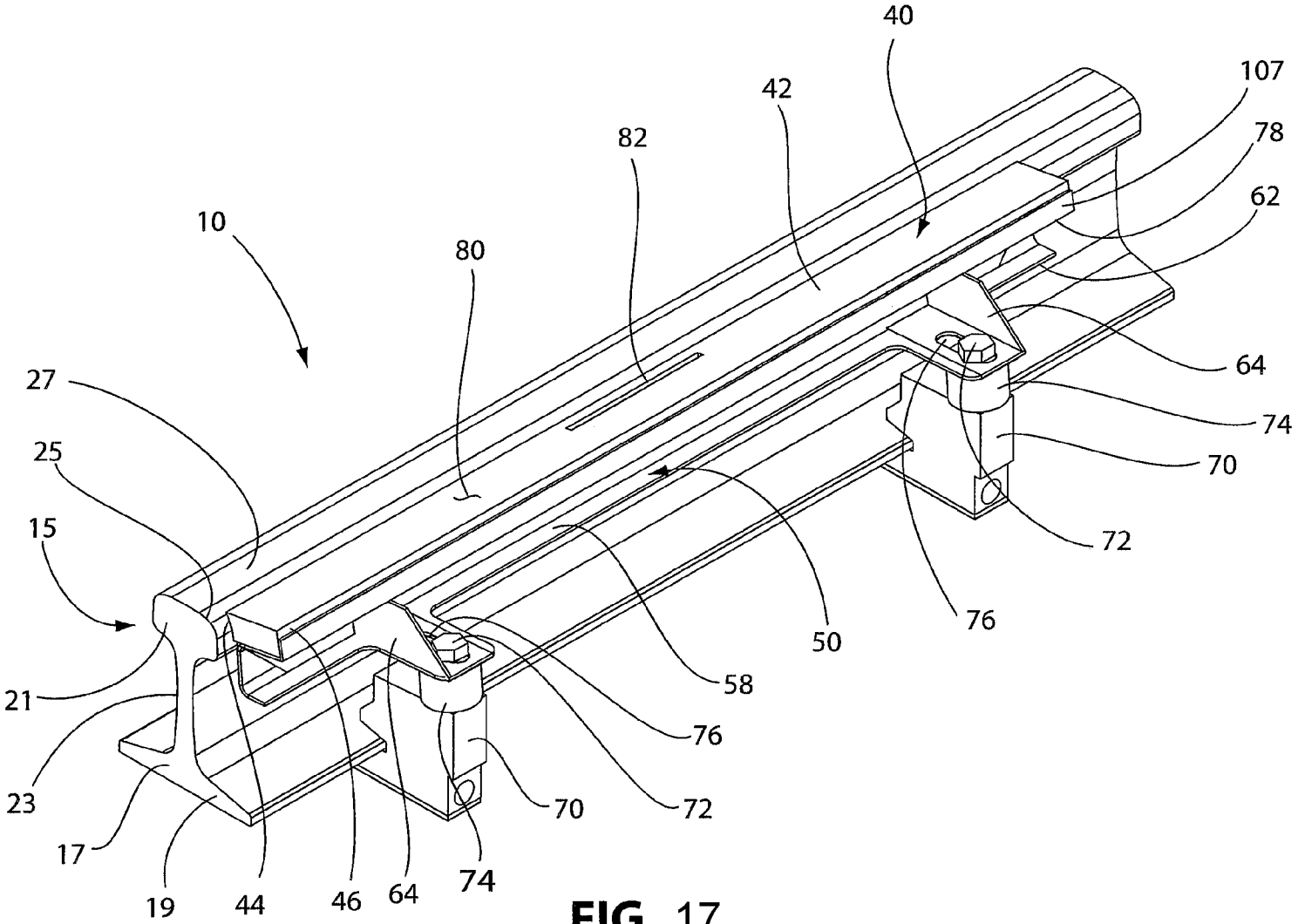
FIG. 17 is a perspective view of a rail applicator according to yet another embodiment of the present invention.
Figure 18:
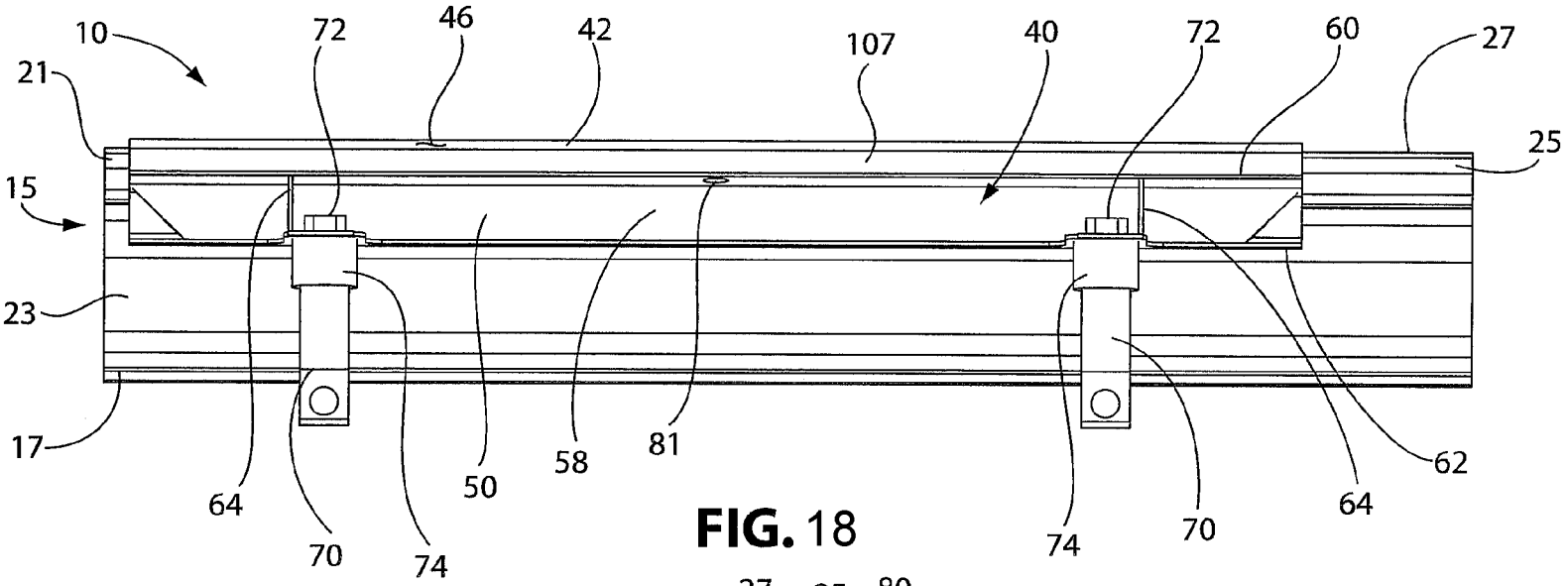
FIG. 18 is a rear view of the rail applicator shown in FIG. 17.
Figure 19:
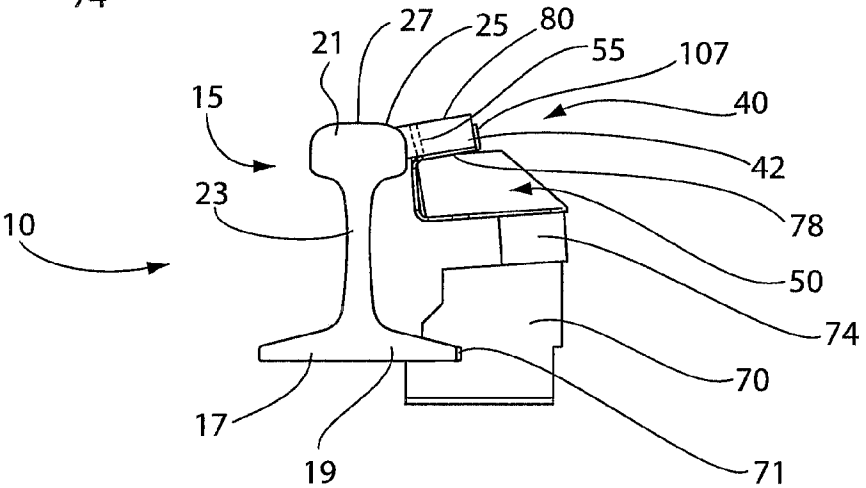
FIG. 19 is a side view of the rail applicator shown in FIG. 17.

Referring to FIGS. 17-19, yet another example of a rail applicator assembly 105 is shown. The rail applicator assembly 105 is similar to the rail applicator assembly 10 shown in FIGS. 1-3. The applicator support 50 of the present embodiment, however, further includes an upward flange 107 extending from the upper surface of the elongate body 58. The upward flange 107 is positioned adjacent the rear surface 46 of the resilient body 42 and is configured to provide support for the resilient body 42 during compression by a passing rail wheel.

All citations are hereby incorporated by reference, as if each individual publication was specifically and individually indicated to be incorporated by reference herein and as though it were fully set forth herein. Citation of references herein is not to be construed nor considered as an admission that such references are prior art to the present invention.

While several embodiments of a rail applicator were described in the foregoing detailed description, it will be apparent to persons skilled in the art that a number of variations and modifications can be made without departing from the scope of the invention as defined in the claims. Examples of such modifications include the substitution of known equivalents for any aspect of the invention in order to achieve the same result in substantially the same way. Accordingly, the foregoing description is intended to be illustrative rather than restrictive.

What is claimed is:

1. A method of applying friction modifying material to a rail, comprising engaging a field surface of a head portion of the rail with an applicator, the applicator comprising an elongate resilient polymeric body defining a passageway consisting of one conduit that extends through the elongate resilient polymeric body and comprising an outer impervious surface, the applicator further comprising a rigid applicator support, wherein a bottom surface of the elongate resilient polymeric body is secured directly to an upper surface of the rigid applicator support, the passageway being impervious to the friction modifying material, and wherein a top surface of the elongate resilient polymeric body has a length that is greater than a length between the top surface and the bottom surface of the elongate resilient polymeric body; and applying the friction modifying material to the field surface of the head portion of the rail by distributing the friction modifying material through the passageway and exiting the passageway via an exit port.

2. The method of claim 1, further comprising:

compressing the applicator against the rail such that the exit port is closed prior to friction modifying material exiting through the exit port.

3. The method of claim 2, wherein in the step of engaging, the exit port of the passageway is closer in proximity to a front surface of the elongate resilient polymeric body than an inlet port of the passageway.

4. The method of claim 2, wherein in the step of engaging:

i) the passageway is wider at the exit port than at an inlet port, ii) the inlet port, the exit port, and the passageway are of a same width, or iii) the passageway is narrower at the exit port than at the inlet port.

5. The method of claim 2, wherein in the step of engaging, the exit port of the passageway is slot-shaped, or circular-shaped.

6. The method of claim 2, wherein in the step of engaging, the rail applicator is mounted so that the top surface of the elongate resilient polymeric body slopes downwardly toward the head portion of the rail.

7. The method of claim 2, wherein in the step of engaging, from 2 to 10 applicators are mounted in series against the rail.

8. The method of claim 1, wherein in the step of engaging, the exit port of the passageway is closer in proximity to a front surface of the elongate resilient polymeric body than an inlet port of the passageway.

9. The method of claim 1, wherein in the step of engaging:

i) the passageway is wider at the exit port than at an inlet port, ii) the inlet port, the exit port, and the passageway are of a same width, or iii) the passageway is narrower at the exit port than at the inlet port.

10. The method of claim 1, wherein in the step of engaging, the exit port of the passageway is slot-shaped, or circular-shaped.

11. The method of claim 1, wherein in the step of engaging, the rail applicator is mounted so that the top surface of the elongate resilient body slopes downwardly toward the head portion of the rail.

12. The method of claim 1, wherein in the step of engaging, from 2 to 10 applicators are mounted in series against the rail.

13. The method of claim 1, wherein all or substantially all of the bottom surface of the elongate resilient polymeric body is secured directly to the upper surface of the rigid applicator support.

14. A method of applying friction modifying material to a rail, comprising engaging a field surface of a head portion of the rail with an applicator, the applicator comprising an elongate resilient polymeric body defining a passageway consisting of one conduit that extends through the elongate resilient polymeric body, the applicator further comprising a rigid applicator support, wherein a bottom surface of the elongate resilient polymeric body is secured directly to an upper surface of the rigid applicator support, the passageway being impervious to the friction modifying material, and wherein a top surface of the elongate resilient polymeric body has a length that is greater than a length between the top surface and the bottom surface of the elongate resilient polymeric body; and applying the friction modifying material to the field surface of the head portion of the rail by distributing the friction modifying material through the passageway and exiting the passageway via an exit port.

15. The method of claim 14, further comprising:

compressing the applicator against the rail such that the exit port is closed prior to friction modifying material exiting through the exit port.

16. The method of claim 15, wherein in the step of engaging, the exit port of the passageway is closer in proximity to a front surface of the elongate resilient polymeric body than an inlet port of the passageway.

17. The method of claim 15, wherein in the step of engaging, the rail applicator is mounted so that the top surface of the elongate resilient polymeric body slopes downwardly toward the head portion of the rail.

18. The method of claim 14, wherein in the step of engaging, the exit port of the passageway is closer in proximity to a front surface of the elongate resilient polymeric body than an inlet port of the passageway.

19. The method of claim 14, wherein in the step of engaging, the rail applicator is mounted so that the top surface of the elongate resilient body slopes downwardly toward the head portion of the rail.

20. The method of claim 14, wherein all or substantially all of the bottom surface of the elongate resilient polymeric body is secured directly to the upper surface of the rigid applicator support.

* * * * *